US008973673B2

(12) United States Patent
Patterson et al.

(10) Patent No.: US 8,973,673 B2
(45) Date of Patent: Mar. 10, 2015

(54) FIRE SPRINKLER HEAD SHUT-OFF TOOL WITH FUSIBLE RELEASE MECHANISM

(75) Inventors: Gregory Alan Patterson, Blue Mountains (CA); Elia Scardaoni, Collingwood (CA); James Edward Ree, Clarksburg (CA)

(73) Assignee: Technicraft Product Design Inc., Collingwood (CA)

( * ) Notice: Subject to any disclaimer, the term of this patent is extended or adjusted under 35 U.S.C. 154(b) by 219 days.

(21) Appl. No.: 13/878,685

(22) PCT Filed: Oct. 13, 2011

(86) PCT No.: PCT/CA2011/001151

§ 371 (c)(1), (2), (4) Date: Apr. 10, 2013

(87) PCT Pub. No.: WO2012/048415

PCT Pub. Date: Apr. 19, 2012

(65) Prior Publication Data

US 2013/0186242 A1 Jul. 25, 2013

Related U.S. Application Data

(60) Provisional application No. 61/344,808, filed on Oct. 15, 2010.

(51) Int. Cl.
*A62C 37/20* (2006.01)
*A62C 37/12* (2006.01)

(52) U.S. Cl.
CPC ..... *A62C 37/20* (2013.01); *A62C 37/12* (2013.01)
USPC ..... 169/90; 81/126

(58) Field of Classification Search
CPC ..... A62C 37/12; A62C 37/20
USPC ..... 169/38, 39, 90; 81/126, 127
See application file for complete search history.

(56) References Cited

U.S. PATENT DOCUMENTS

| | | | |
|---|---|---|---|
| 1,028,247 | A | 6/1912 | Morey |
| 1,325,507 | A | 12/1919 | Casey |
| 2,234,290 | A | 3/1941 | Tessier |
| 2,743,782 | A | 5/1956 | Occhipinti |
| 3,550,687 | A | 12/1970 | Thaxton |
| D347,681 | S | 6/1994 | Scardaoni |
| 7,743,838 | B2 | 6/2010 | Wilson |

*Primary Examiner* — David B Thomas

(57) ABSTRACT

The disclosed invention relates to a fire sprinkler shut-off tool for stopping water flow from an activated fire sprinkler head. Due to the lack of any automatic safety release mechanisms, such tools currently on market suffer the disadvantage of requiring constant monitoring in case fire rekindles. The shut-off tool comprising a pair of adjustable clamping arms and an actuator assembly for adjusting and fixing the clamping arms addresses the safety issue by integrating a fusible link locking tab into the actuator assembly. The presence of a nearby fire melts and separates the locking tab thereby releasing the clamping arms from an activated fire sprinkler head. The shut-off tool also addresses the safety problem of firemen or building maintenance personnel using a shut-off device that requires two hands while working from a ladder as this device can be easily used with one hand. The shut-off tool also achieves the object of universal fit on most fire sprinkler heads by use of the adjustable angled clamping arms and by locating a sealing surface on each of the clamping arms so as to permit operation with fire sprinklers mounted in an upright position.

19 Claims, 10 Drawing Sheets

FIRE SPRINKLER HEAD SHUT-OFF TOOL WITH FUSIBLE RELEASE MECHANISM

RELATED APPLICATIONS

This application claims the benefit of 35 U.S.C. 119(e) to U.S. Provisional Patent Application Ser. No. 61/344,808, filed on 15 Oct. 2010.

SCOPE OF THE INVENTION

The present invention relates to a shut-off tool for stopping flow of a liquid from an opening. More preferably, the present invention relates to a shut-off tool for stopping water flow from an activated fire sprinkler head. In one particular aspect, the present invention relates to a fire sprinkler head shut-off tool comprising a pair of adjustable clamping arms and an actuator assembly including a locking tab made of a fusible link that can be operated with one hand and which is capable of shutting off both pendant and upright fire sprinkler heads from bottom.

BACKGROUND OF THE PRIOR ART

Conventional fire sprinkler heads found in most homes and buildings function as controlled outlets of a central water source. On a typical fire sprinkler head, a pipe cap is firmly held in place against the water outlet or orifice by a breakable glass bulb containing temperature sensitive liquid. When the liquid is heated by a nearby fire, it expands rapidly until it reaches a predetermined threshold temperature at which it causes the glass bulb to break and release the pipe cap. Once activated as such, water flows freely through the water outlet at a high rate.

Normally, fire sprinkler heads do not have individual shut-off valves and the only means of deactivation is by shutting off the main or branch valve of their central water source. Frequently, there is no ready access to the shut off valves and the high rate of water flow from activated fire sprinkler heads could lead to extensive water damages to affected areas. Therefore, it is desirable to have the means to individually deactivate fire sprinkler heads without time delay to locate the main valve.

One earlier fire sprinkler head shut-off tool is described in U.S. Pat. No. 7,743,838 to Wilson. Wilson discloses a fire sprinkler head shut-off tool comprising a handle with a jaw, a stopper arm which is equipped with a stopper to come directly in contact with an orifice of an activated fire sprinkler head, a lever to operate the tool and a means for reciprocating the stopper arm as the lever is rotated. The tool operates by hooking the jaw of the handle around the upper portion of the fire sprinkler head and raising the stopper into the orifice of the fire sprinkler head by rotating the lever until the stopper is fitted into the orifice. The lever is then locked into the position by a locking mechanism.

The shut-off tool described by Wilson suffers three major disadvantages: one being that it permanently deactivates the fire sprinkler head. Once the stopper is locked into the orifice of the fire sprinkler head, the tool must be removed manually to resume water flow therefrom if a fire rekindles. Such disadvantage necessitates constant monitoring to manually release the tool if the fire does rekindle. The second major disadvantage is that it requires two hands to operate. This is a safety concern when working from a ladder. The third disadvantage is that to shut off an upright fire sprinkler head the tool of Wilson must be inverted. Upright fire sprinkler heads are often located in confined spaces such as parking lots which do not provide the room or access to operate the shut-off tool of Wilson in an inverted manner.

SUMMARY OF THE INVENTION

It is therefore an object of the present invention to provide an improved fire sprinkler shut-off tool for stopping water flow from an activated fire sprinkler head, which overcomes the disadvantages noted above. Specifically, an object of the invention is to provide a fire sprinkler head shut-off tool which automatically disengages from the fire sprinkler head thereby reactivating the fire sprinkler if the fire rekindles.

A second object of the present invention is to provide a fire sprinkler shut-off device that can be operated with one hand thus providing improved safety for the operator.

A third object of the present invention is to provide an improved fire sprinkler shut-off tool for stopping water flow from an activated fire sprinkler head, which can be configured to work with most fire sprinkler heads of varying sizes and positions especially the new recessed head configurations.

A fourth object of the present invention is to provide a shut-off tool for stopping flow of a liquid from an opening, and which automatically disengages from the opening to allow continued flow when a predetermined threshold temperature is reached.

In one simplified aspect, the present invention provides a shut-off tool for stopping flow of a liquid from an opening having an orifice and a distal member spaced from the orifice, the shut-off tool comprising a pair of movable arms and an actuator assembly for moving or positioning the movable arms. The actuator assembly incorporates a drive mechanism, which may for example include a camming member, for moving one or both of the moving arms to an operating position where one of the moving arms is in fluid sealing contact with the orifice to substantially prevent flow therefrom and the other moving arm is in engageable contact with the distal member; and a locking mechanism for selectively locking the movable arms in the position. The locking mechanism and/or the movable arms include a fusible release portion selected to melt at a predetermined threshold temperature, such as a fusible link or link plates coupled with a fusible alloy. When incorporated into the locking mechanism, the fusible release portion induces failure of the locking mechanism upon reaching the threshold temperature so as to effect release of the shut-off tool from the opening. Alternatively, or in addition, the fusible portion could be incorporated into one or both of the movable arms so to induce severing of the movable arms when the threshold temperature is reached and to disengage the shut-off tool from the opening.

In one embodiment of the present invention, there is provided an improved fire sprinkler shut-off tool for stopping water flow from an activated fire sprinkler head comprising a frame, a pair of adjustable clamping arms with rubber tips and an actuator assembly, which includes a locking tab made from a fusible link. The locking tab comprises two separate link plates soldered together by low melt solder which melts at a predetermined threshold temperature. The adjustable clamping arms include a lower clamping arm fixedly attached to the frame and an upper clamping arm attached to a rod that is slidingly engaged to a push tab and the locking tab of the actuator assembly.

The shut-off tool is operated by inserting the adjustable clamping arms into the nest of the activated fire sprinkler head. By using the actuator assembly the upper (or lower, depending upon sprinkler orientation) clamping arm that is covered with a compressible rubber surface is brought into engageable contact with the orifice of the fire sprinkler head thereby stopping water flow therefrom.

The shut-off tool automatically releases from the fire sprinkler head when the predetermined threshold temperature is reached at the locking tab. In one simplified construction, heat applied to the locking tab causes it to fragment into individual pieces at the pre-determined threshold temperature, releasing the rod and the upper clamping arm from the fire sprinkler head and thus dropping out of the sprinkler head.

In a further aspect, the present invention provides a fire sprinkler head shut-off tool for stopping water flow from an activated fire sprinkler head having a valve seat and a distal portion spaced from the valve seat, the shut-off tool comprising:

a pair of adjustable clamping arms, the clamping arms being selectively movable between a first position and an operating position where a first one of the clamping arms is in seated fluid sealing contact with the valve seat to substantially prevent water flow therefrom and a second one of the clamping arms is in engageable contact with the distal portion, and an actuator assembly comprising:

a camming tab for selectively engaging at least one of said clamping arms for effecting movement of the clamping arms from the first position towards the operating position;

a spring assembly for resiliently biasing the clamping arms towards the first position; and a locking mechanism having at least one fusible link for selectively locking the clamping arms in the operating position against the bias of the spring assembly, wherein the fusible link is selected to melt at a predetermined threshold temperature, and wherein melting of the fusible link effects unlocking of the clamping arms to permit their movement towards the first position under the bias of the spring assembly.

Preferably, the clamping arms comprise a resiliently deformable tip such as a rubber tip. The locking mechanism may include a manual release portion for selectively unlocking the clamping arms. The fusible link preferably includes a low melting solder having a melting point between 125° F. and 500° F. More preferably, the melting point is between 130° F. to 170° F.

In a preferred construction, the actuator assembly includes a frame, the second clamping arm is coupled to the frame, and the first clamping arm comprises a rod selectively extendible by the actuator assembly towards the operating position. Most preferably, the actuator assembly further includes a handle, and the camming tab comprises a first cavity for slidably receiving the rod and which is sized to selectively engage the rod to effect its axial extension towards the operating position under bias of the handle.

In a most preferred construction, the fusible link comprises a first and second link plates each comprising a notch. The notches combine to form a second cavity for slidably receiving the rod and which is sized to selectively engage the rod to prevent its axial retraction against the bias of the spring assembly. Alternatively, the fusible link may comprise a plurality of link plates, at least one of the plurality of link plates having a second cavity for slidably receiving the rod and which is sized to selectively engage the rod to prevent its axial retraction against the bias of the spring assembly.

In a yet further aspect, the present invention provides A shut-off tool for stopping flow of a liquid from an opening having an orifice and a distal member spaced from the orifice, the shut-off tool comprising:

a pair of adjustable clamping arms, the clamping arms being selectively movable relative to each other between a non-engaged position, wherein the clamping arms are movable to a position interposed between the orifice and the distal member, and an operating position where a first one of the clamping arms is in seated fluid sealing contact with the orifice to substantially prevent fluid flow therefrom and a second one of the clamping arms is in engageable contact with the distal member, and an actuator assembly including a drive mechanism, a spring assembly and a locking mechanism, the drive mechanism actionable to selectively move the clamping arms from the non-engaged position towards the operating position;

the spring assembly operable to resiliently bias the clamping arms towards the non-engaged position; and the locking mechanism including a plurality of link plates coupled with a fusible alloy for selectively locking the clamping arms in the operating position against the bias of the spring assembly, wherein the fusible alloy is selected to melt at a predetermined threshold temperature, and wherein melting of the fusible alloy uncouples the link plates to effect unlocking of the clamping arms and permit their movement towards the non-engaged position under the bias of the spring assembly.

Preferably, the clamping arms comprise a resiliently deformable tip such as a rubber tip. The locking mechanism may include a manual release portion for selectively unlocking the clamping arms. The fusible alloy preferably comprises a low melting solder having a melting point between about 125° F. and about 500° F. More preferably, the melting point is between about 130° F. to about 170° F.

In a preferred construction, the actuator assembly includes a frame, one of the clamping arms is coupled to the frame, and the other clamping arm comprises a rod selectively extendible by the actuator assembly towards the operating position. Most preferably, the actuator assembly further includes a handle, and the drive mechanism comprises camming tab having a first cavity for slidably receiving the rod and which is sized to selectively engage the rod to effect its axial extension towards the operating position under bias of the handle.

In a most preferred construction, the link plates include a first and second link plates each comprising a notch. The notches combine to form a second cavity for slidably receiving the rod and which is sized to selectively engage the rod to prevent its axial retraction against the bias of the spring assembly. Alternatively, at least one of the plurality of link plates may comprise a second cavity for slidably receiving the rod and which is sized to selectively engage the rod to prevent its axial retraction against the bias of the spring assembly.

In a yet further aspect, the present invention provides a shut-off tool for stopping flow of a liquid from an opening having an orifice and a distal member spaced from the orifice, the shut-off tool comprising:

a pair of adjustable clamping arms, the clamping arms being selectively movable relative to each other between a non-engaged position and an opearting position where a first one of the clamping arms is in seated fluid sealing contact with the orifice to substantially prevent fluid flow therefrom and a second one of the clamping arms is in engageable contact with the distal member, at least one of the clamping arms comprising a fusible link selected to melt at a predetermined threshold temperature, and an actuator assembly including a drive mechanism and a locking mechanism, the drive mechanism actionable to selectively move the clamping arms from the non-engaged position towards the operating position; and the locking mechanism operable to selectively lock the clamping arms in the operating position, wherein melting of the fusible link in the engaged position releases the clamping arms to effect their disengagement from the opening.

Preferably, the clamping arms comprise a resiliently deformable tip such as a rubber tip. The locking mechanism may include a manual release portion for selectively unlocking the clamping arms. The fusible link preferably comprises a low melting solder having a melting point between about 125° F. and about 500° F. More preferably, the melting point is between about 130° F. to about 170° F.

In a preferred construction, the actuator assembly includes a frame, one of the clamping arms is coupled to the frame, and the other clamping arm comprises a rod selectively extendible by the actuator assembly towards the operating position. Most preferably, the actuator assembly further includes a handle, and the drive mechanism comprises a caroming tab having a first cavity for slidably receiving the rod and which is sized to selectively engage the rod to effect its axial extension towards the operating position under bias of the handle.

In a most preferred construction, the actuator assembly comprises a spring assembly for resiliently biasing the clamping arms towards the non-engaged position, and the locking mechanism comprises at least one fusible link for selectively locking the clamping arms in the operating position against the bias of the spring assembly, wherein the fusible link is selected to melt at the predetermined threshold temperature, and wherein melting of the fusible link effects unlocking of the clamping arms to permit their movement towards the non-engaged position under the bias of the spring assembly.

Most preferably, the fusible link comprises first and second link plates each comprising a notch, wherein the notches combine to form a second cavity for slidably receiving the rod and which is sized to selectively engage the rod to prevent its axial retraction against the bias of the spring assembly. Alternatively, the fusible link may comprise a plurality of link plates, at least one of the plurality of link plates having a second cavity for slidably receiving the rod and which is sized to selectively engage the rod to prevent its axial retraction against the bias of the spring assembly.

BRIEF DESCRIPTION OF THE DRAWINGS

Reference may now be had to the following detailed description, taken together with the accompanying drawings, in which.

DETAILED DESCRIPTION OF THE INVENTION

Figure 1:
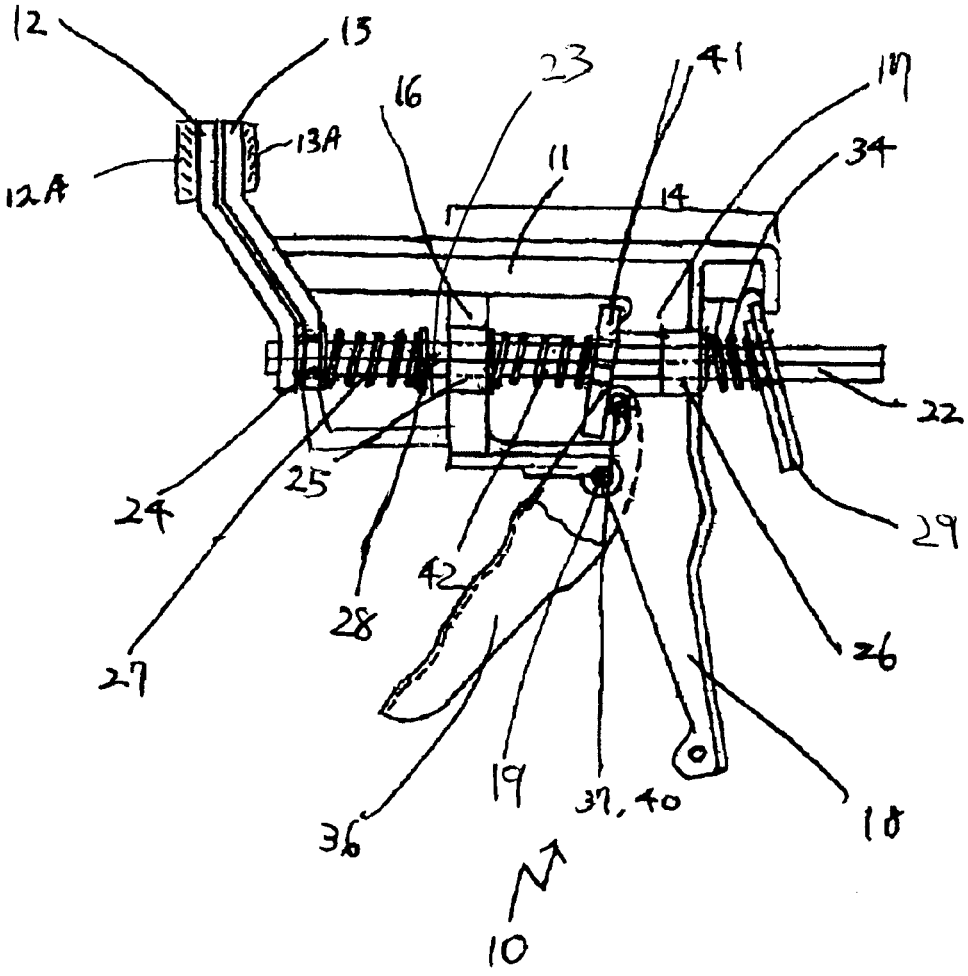
FIG. 1 is a skeletal side view of a shut-off tool in accordance with a preferred embodiment of the present invention.

Reference is made to FIG. 1 which illustrates a fire sprinkler head shut-off tool 10 in accordance with a preferred embodiment of the present invention. The shut-off tool comprises a frame 11, a pair of adjustable clamping arms 12 and 13, and an actuator assembly 14.

Figure 2:
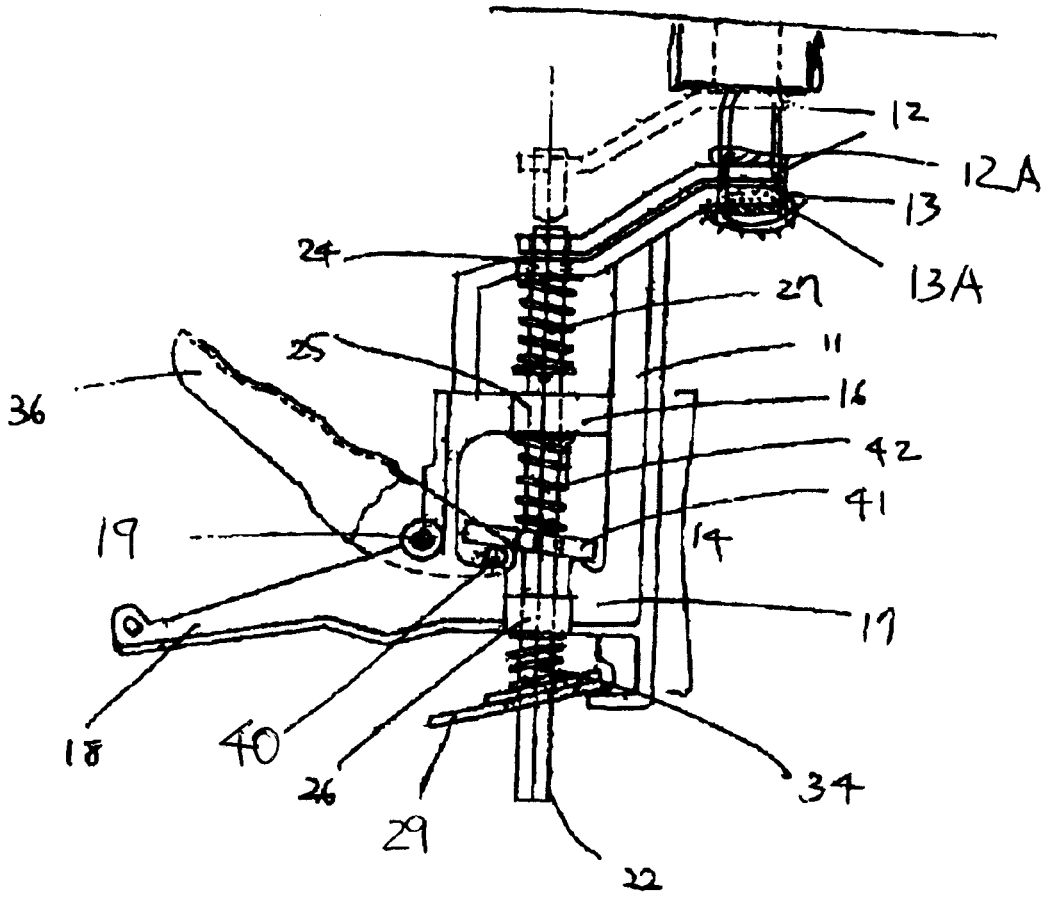
FIG. 2 is a side view of the shut-off tool, additionally showing in phantom the movement of the movable clamping arm assembly in engageable contact with the nest of a fire sprinkler head.
Figure 3:
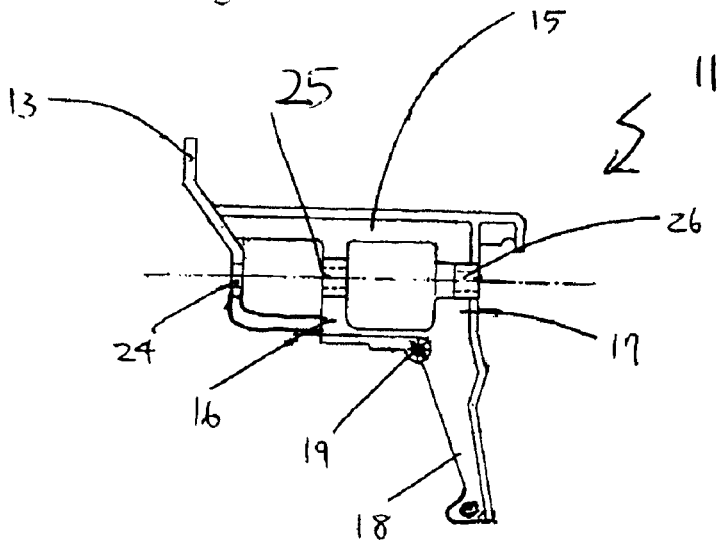
FIG. 3 is a side view of a frame used in the shut-off tool of FIG. 1.
Figure 3A:
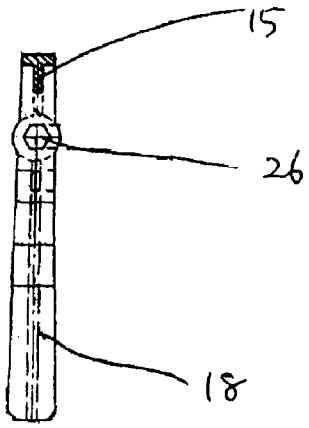
FIG. 3A is a cross-sectional view of the frame shown in FIG. 3 taken at section A-A.
Figure 3B:
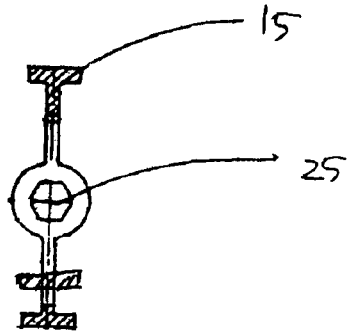
FIG. 3B is a cross-sectional view of the frame shown in FIG. 3 taken at section B-B.
Figure 3C:
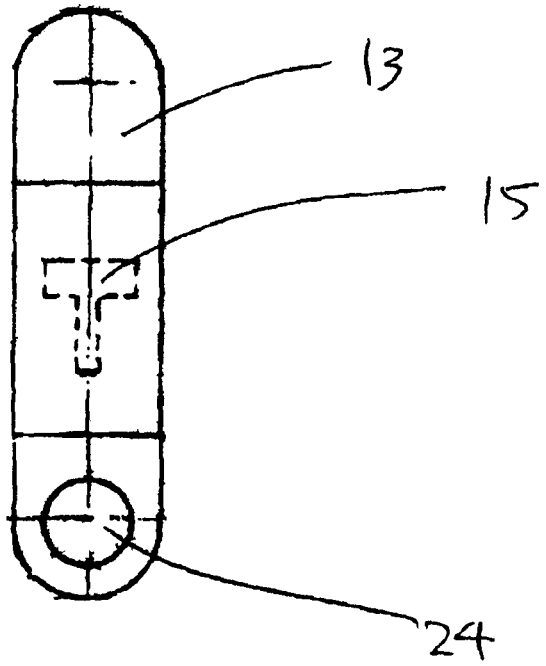
FIG. 3C is a front elevational view of a lower clamping arm used in the front side of the frame.

As shown best in FIG. 3, the frame 11 includes a spine 15, a lower clamping arm 13, front and rear actuator support columns 16 and 17, a strut 50, a lanyard hole 51 and a handle 18 together forming one solid metal structure. The lower clamping arm 13 is mounted to a forward end of the spine 15 in such a way that its flat surface is positioned at a slight angle to the side surface of the frame 11. The frame also includes a bolt hole 19 in front of the handle 18 and adjacent to the rear actuator support column 17 for receiving an attachment bolt as shown in FIG. 2.

Figure 4:
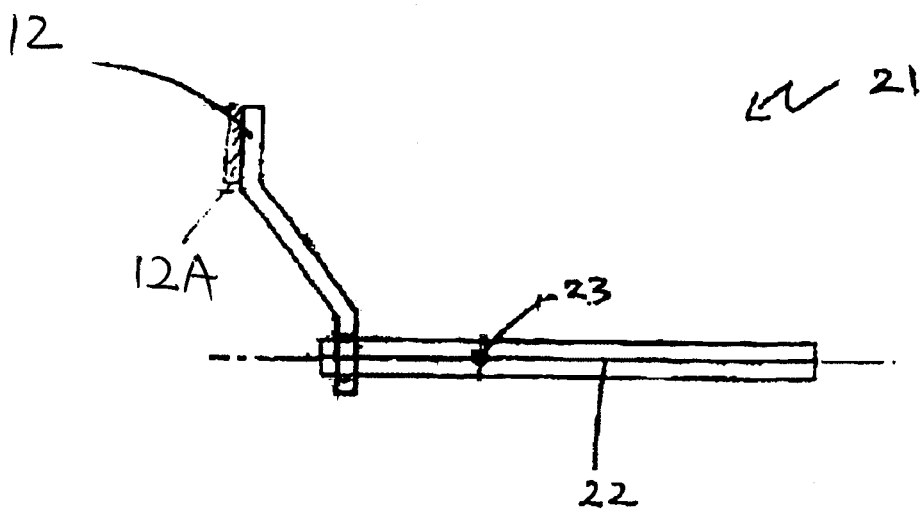
FIG. 4 is a side view of a movable clamping arm assembly.
Figure 4A:
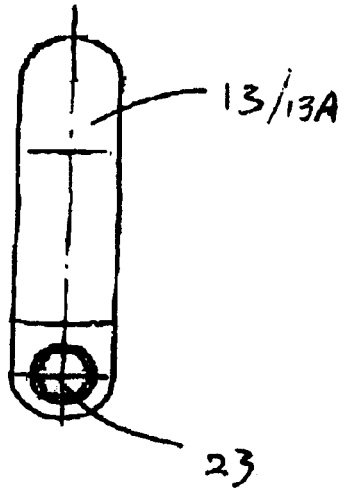
FIG. 4A is a front elevational view of an upper clamping arm.
Figure 4B:
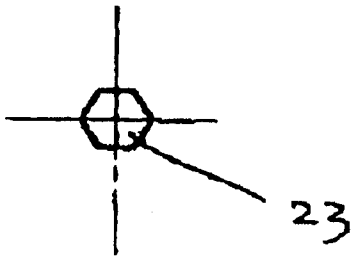
FIG. 4B is a cross-sectional view of a rod.

In reference to FIGS. 1 and 4, a movable clamping arm assembly 21 includes the upper clamping arm 12 with an attached rubber surface 12A, fixedly attached to a forward end of a rod 22, and a roll pin hole 23 pierced through the rod 22. FIG. 4A illustrates the upper clamping arm 12 has a flat surface when viewed from the front surface of the movable clamping arm assembly 21 and FIG. 4B illustrates that the rod has hexagonal cross-section. The forward flat surface of the upper clamping arm 12 is covered with a compressible rubber surface 12A that seals against the orifice of the fire sprinkler heads.

In reference to FIGS. 1 and 2, the lower clamping arm 13 and the front and rear actuator support columns 16 and 17 are pierced with coaxially aligned front aperture 24, middle aperture 25 and rear aperture 26, respectively, to form a single passage to slidably receive the rod 22 through the aligned apertures 24, 25 and 26. The movable clamping arm assembly 21 is biased in movement rearwardly by a helical compression spring 27 seated between the lower clamping arm 13 and a spring seat 28 on the rod 22 providing constant rearward tension on the movable arm assembly 21.

Figure 5:
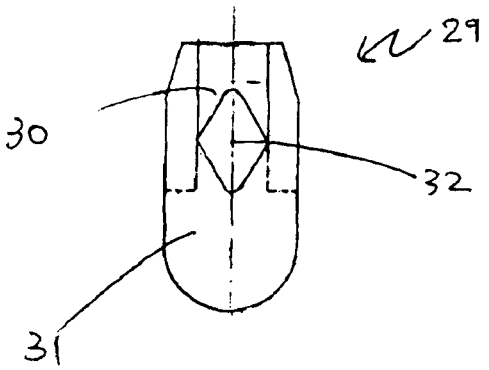
FIG. 5 is a schematic view of a locking tab used to clamp the movable clamping arm assembly.

FIG. 5 illustrates a locking tab 29 in an assembled form consisting of upper and lower link plates 30 and 31 welded together by way of a low melting point solder as a fusible link. Preferably, the low melting point solder is selected to melt at the predetermined threshold temperature of about 125° F. to 500° F. and preferably at about 130° F. to 170° F. Both link plates 30 and 31 as illustrated separately in FIGS. 5A and 5B, respectively, are U-shaped to provide a locking tab hole 32 when assembled into the locking tab 29. The hole size is selected to disengage the rod 22 in forward sliding movement and not permit rearward sliding movement through when in its normally engaging position shown in FIG. 1.

Figure 5A:
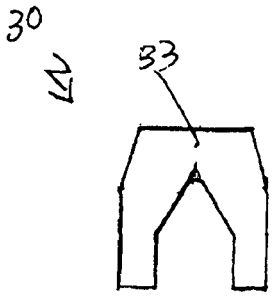
FIG. 5A is a schematic view of an upper link plate used in the assembly of the locking tab as shown in FIG. 5.
Figure 5B:
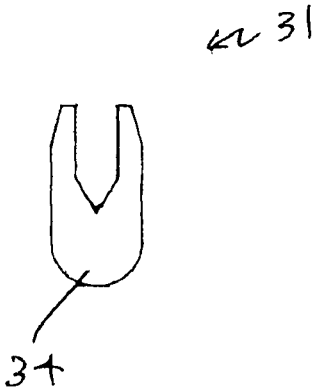
FIG. 5B is a schematic view of a lower link plate used in the assembly of the locking tab as shown in FIG. 5.
Figure 5C:
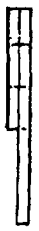
FIG. 5C is a side view of the locking tab as shown in FIG. 5.

The upper link plate 30 as illustrated in FIG. 5A contains a locking tab catch 33. As best illustrated in FIGS. 1 and 2, the catch size is selected to pivotally lodge the locking tab 29 to the frame 11 against the constant rearward tension provided by a helical compression spring 34 seated against the rear side of the rear actuator support column 17 and the locking tab 29. The lower link plate 31 as illustrated in FIG. 5B contains a locking tab manual release 35. As shown best in FIG. 1 when force is applied forwardly on the manual release 35, the locking tab 29 pivots forward and out of its normally engaging position and permit rearward sliding movement of the rod 22 until the force is removed.

Figure 9:
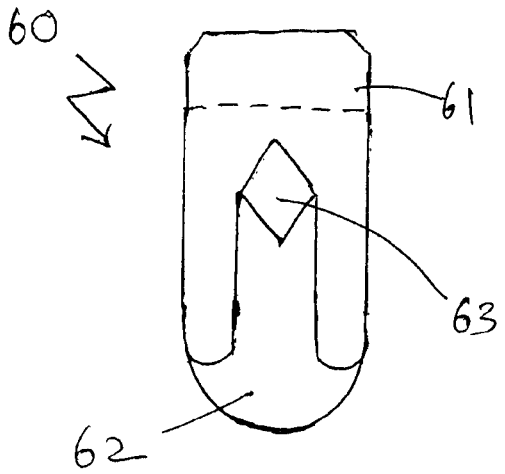
FIG. 9 is a schematic view of a locking tab for clamping the movable clamping arm assembly.

FIG. 9 illustrates another locking tab 60, a variation of the locking tab 29 shown in FIG. 5. The locking tab 60 consists of upper and lower link plates 61 and 62 welded together by way of a low melting point solder as a fusible link. Preferably, the low melting point solder is selected to melt at the predetermined threshold temperature of about 125° F. to 500° F. and preferably at about 130° F. to 170° F. The lower link plate 62 includes an enclosed hole 63 sized to disengage the rod 22 in forward sliding movement and not permit rearward sliding movement through when in its normally engaging position shown in FIG. 1. The upper link plate 61 is U-shaped for axial alignment with the enclosed hole 63 of the lower link plate 62 in the assembled form as shown in FIG. 9.

Figure 10:
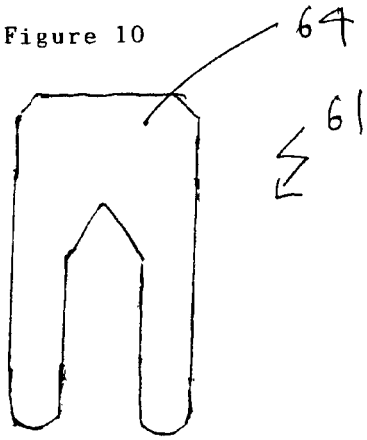
FIG. 10 is a schematic view of an upper link plate used in the assembly of the locking tab as shown in FIG. 9.
Figure 11:
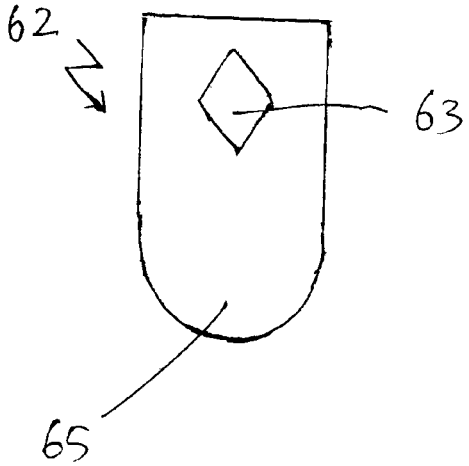
FIG. 11 is a schematic view of a lower link plate used in the assembly of the locking tab as shown in FIG. 9.
Figure 12:
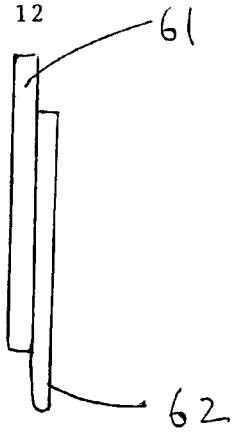
FIG. 12 is a side view of the locking tab as shown in FIG. 9.

Like the lower link plate 31, and as shown in FIG. 11, the lower link plate 62 of the locking tab 60 contains a locking tab manual release 65 operable for selectively permitting rearward sliding movement of the rod 22. Like the upper link plate 30, and as shown in FIG. 10, the upper link plate 61 includes a locking tab catch 64 operable for pivotally lodging the locking tab 60 to the frame 11 against the constant rearward tension provided by the helical compression spring 34. Preferably, the upper link plate 61 is located in direct contact with the helical compression spring 34 so as to maintain the solder of the locking tab 60 in shear rather than in tension.

Figure 7:
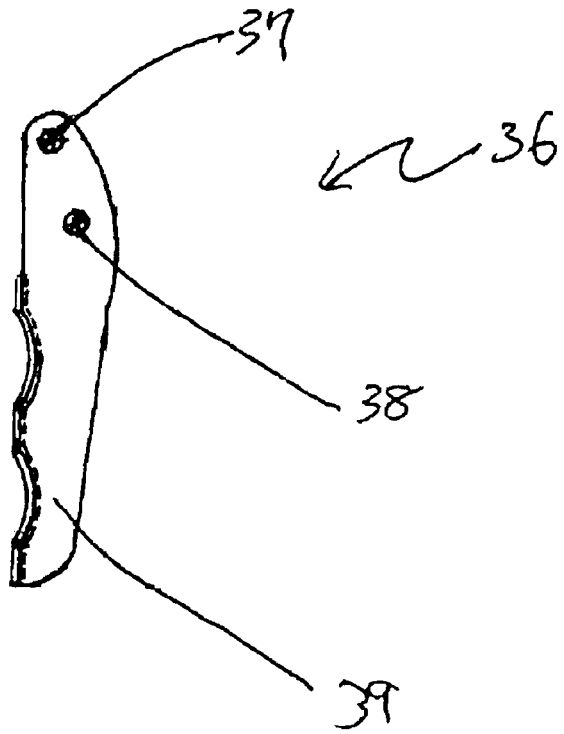
FIG. 7 is a side view of a push trigger.

FIG. 7 illustrates a push trigger 36 which includes two bolt holes 37 and 38 and a push trigger handle 39. The bolt hole 38 receives an attachment bolt or rivet for pivotally attaching the push trigger 36 to the frame 11. The bolt hole 37 fixedly receives an actuator bolt or rivet 40 in direct contact with a push tab 41.

Figure 6:
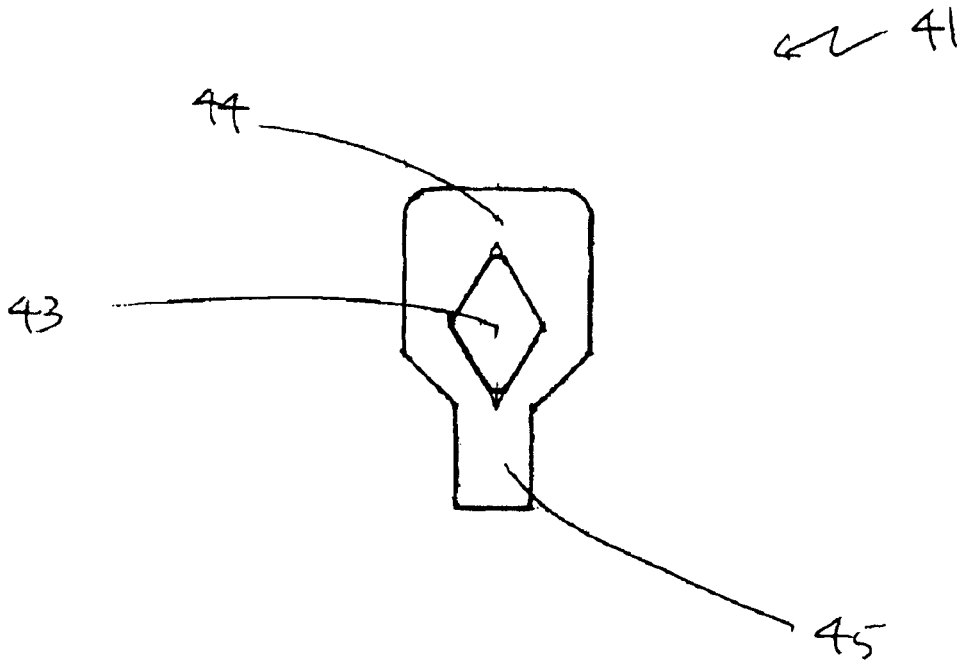
FIG. 6 is a front view of a push tab.

FIG. 6 shows the push tab 41 which is illustrated in FIG. 1 as being biased in movement by a helical compression spring 42 seated between the rear side of the front actuator support column 16 against the push tab 41. As illustrated in FIG. 6, the push tab 41 include a rod catch 43, a push tab rest surface 44 at the top and a push trigger contact 45 at the bottom. The rod catch 43 is sized to slidingly engage the rod 22 in forward movement as the actuator bolt 40 forwardly moves under the bias of the handle. The rod catch 43 is further sized to slidingly disengage from the rod 22 and permit rearward movement of the push tab 41 back to its resting position as illustrated in FIG. 1 when the bias on the handle is removed.

Reference is made to FIG. 2 which illustrates the shut-off tool 10 further showing in phantom the movable clamping arm assembly 21 in engageable contact with the fire sprinkler head. The shut-off tool 10 is operated by first vertically inserting the pair of adjustable clamping arms 12 and 13 into the nest of the fire sprinkler head and resting the lower clamping arm 13 having a compressible rubber surface 13A on the bottom of the nest. By the bias of the push trigger handle 73, the movable clamping arm assembly 21 is moved forward towards the orifice of the fire sprinkler head until the front surface of the upper clamping arm 12 having the compressible rubber surface 12A seats against the orifice.

The shut-off tool 10 automatically disengages from the fire sprinkler head when the predetermined threshold temperature is reached at the locking tab 29. If desired, the shut-off tool 10 can also be manually removed by pressing on the locking tab manual release 35.

Figure 8:
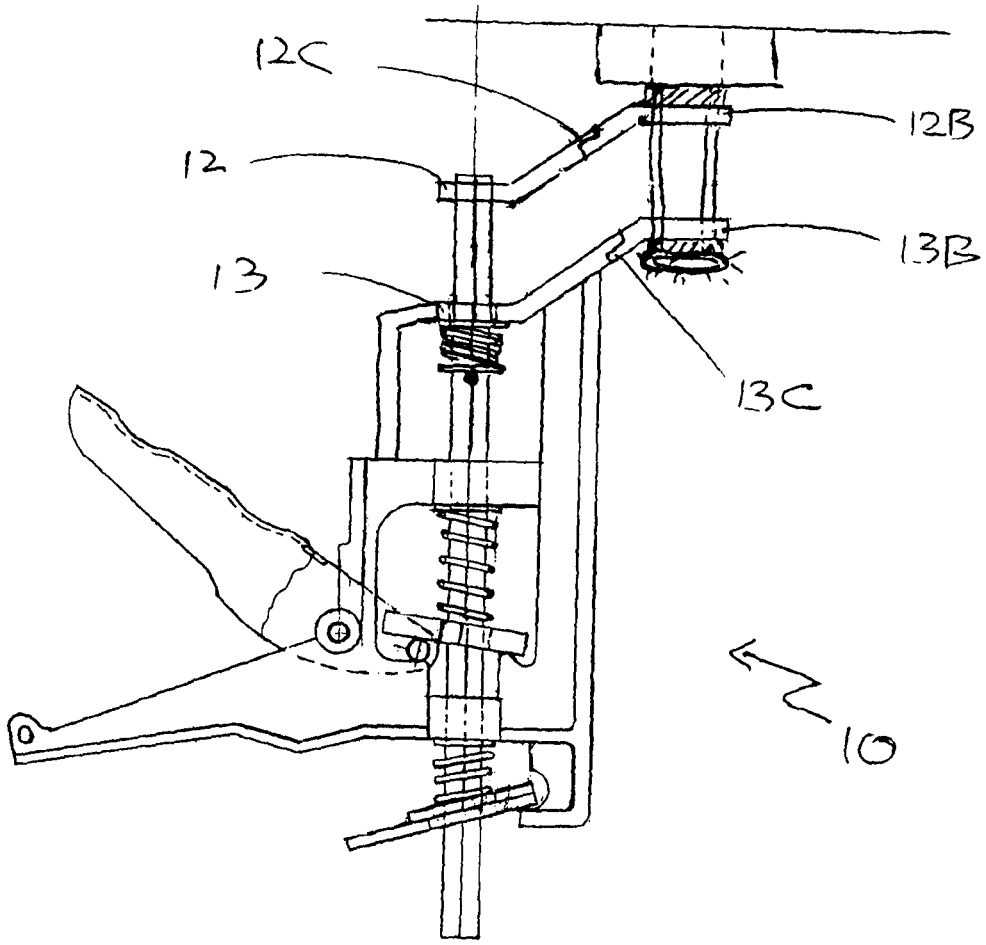
FIG. 8 is a skeletal side view of a shut-off tool in accordance with a preferred embodiment of the present invention.

For added safety or redundancy, fusible construction could also be incorporated into both of the adjustable clamping arms 12 and 13 in addition to the locking tab 29 as best illustrated in FIG. 8. As shown in FIG. 8, the upper clamping arm 12 takes a two-piece construction to include a first break-away portion 12B welded to the upper clamping arm 12 at the first interface 12C using the low melting point solder. Similarly, the lower clamping arm 13 includes a second break-away portion 13B welded at the second interface 13C using the same. In operation, if the locking tab 29 fails to automatically disengage the shut-off tool 10 and resume water flow despite having reached the predetermined threshold temperature, the first and second break-away portions 12B and 13B decouple from the upper and lower clamping arms 12 and 13, respectively, to disengage the shut-off tool 10. Alternatively, the fusible link construction may be incorporated into any one or two of the locking tab 29, and the upper and lower clamping arms 12 and 13 for automatic disengagement of the shut-off tool at the predetermined threshold temperature.

The most preferred embodiments of the present invention are described with reference to FIGS. 1 to 12 hereto. The most preferred embodiments are provided as mere examples which are in no way intended to limit the scope of the present invention. It will be readily apparent to a person skilled in the art that variations and modifications may be made to the most preferred embodiments within the scope of the present invention as described herein.

We claim:

1. A fire sprinkler head shut-off tool for stopping water flow from an activated fire sprinkler head having a valve seat and a distal portion spaced from the valve seat, the shut-off tool comprising:

a pair of adjustable clamping arms, the clamping arms being selectively movable between a first position and an operating position where a first one of the clamping arms is in seated fluid sealing contact with the valve seat to substantially prevent water flow therefrom and a second one of the clamping arms is in engageable contact with the distal portion, wherein the first clamping arm comprises a rod selectively extendible towards the operating position, and an actuator assembly comprising:

a frame coupled to the second clamping arm;

a handle;

a camming tab having a first cavity for slidably receiving the rod and which is sized to selectively engage the rod to effect its axial extension towards the operation position under bias of the handle;

a spring assembly for resiliently biasing the clamping arms towards the first position; and a locking mechanism having at least one fusible link for selectively locking the clamping arms in the operating position against the bias of the spring assembly, wherein the fusible link is selected to melt at a predetermined threshold temperature, and wherein melting of the fusible link effects unlocking of the clamping arms to permit their movement towards the first position under the bias of the spring assembly.

2. The shut-off tool of claim 1, wherein each of the clamping arms comprise a resiliently deformable tip.

3. The shut-off tool of claim 1, wherein the locking mechanism comprises a manual release portion operable to selectively unlock the clamping arms.

4. The shut-off tool of claim 1, wherein the fusible link comprises a low melting solder having a melting point between 125° F. and 500° F.

5. The shut-off tool of claim 1, wherein the fusible link comprises first and second link plates each comprising a notch, wherein the notches combine to form a second cavity for slidably receiving the rod and which is sized to selectively engage the rod to prevent its axial retraction against the bias of the spring assembly.

6. The shut-off tool of claim 1, wherein the fusible link comprises a plurality of link plates, at least one of the plurality of link plates having a second cavity for slidably receiving the rod and which is sized to selectively engage the rod to prevent its axial retraction against the bias of the spring assembly.

7. A shut-off tool for stopping flow of a liquid from an opening having an orifice and a distal member spaced from the orifice, the shut-off tool comprising:

a pair of adjustable clamping arms, the clamping arms being selectively movable relative to each other between a non-engaged position, wherein the clamping arms are movable to a position interposed between the orifice and the distal member, and an operating position where a first one of the clamping arms is in seated fluid sealing contact with the orifice to substantially prevent fluid flow therefrom and a second one of the clamping arms is in engageable contact with the distal member, wherein either one of the clamping arms comprises a rod selectively extendible towards the operating position, and an actuator assembly including a frame, a handle, a drive mechanism, a spring assembly and a locking mechanism, the frame being coupled to the remaining one of the clamping arms;

the drive mechanism comprising a camming tab having a first cavity for slidably receiving the rod and which is sized to selectively engage the rod to effect its axial extension towards the operating position under bias of the handle;

the spring assembly operable to resiliently bias the clamping arms towards the non-engaged position; and the locking mechanism including a plurality of link plates coupled with a fusible alloy for selectively locking the clamping arms in the operating position against the bias of the spring assembly, wherein the fusible alloy is selected to melt at a predetermined threshold temperature, and wherein melting of the fusible alloy uncouples the link plates to effect unlocking of the clamping arms and permit their movement towards the non-engaged position under the bias of the spring assembly.

8. The shut-off tool of claim 7, wherein each of the clamping arms comprise a resiliently deformable tip.

9. The shut-off tool of claim 7, wherein the locking mechanism comprises a manual release portion operable to selectively unlock the clamping arms.

10. The shut-off tool of claim 7, wherein the fusible alloy comprises a low melting solder having a melting point between 125° F. and 500° F.

11. The shut-off tool of claim 7, wherein the plurality of link plates comprises first and second link plates each comprising a notch, wherein the notches combine to form a second cavity for slidably receiving the rod and which is sized to selectively engage the rod to prevent its axial retraction against the bias of the spring assembly.

12. The shut-off tool of claim 7, wherein at least one of the plurality of link plates comprise a second cavity for slidably receiving the rod and which is sized to selectively engage the rod to prevent its axial retraction against the bias of the spring assembly.

13. A shut-off tool for stopping flow of a liquid from an opening having an orifice and a distal member spaced from the orifice, the shut-off tool comprising:

a pair of adjustable clamping arms, the clamping arms being selectively movable relative to each other between a non-engaged position and an operating position where a first one of the clamping arms is in seated fluid sealing contact with the orifice to substantially prevent fluid flow therefrom and a second one of the clamping arms is in engageable contact with the distal member, at least one of the clamping arms comprising a fusible link selected to melt at a predetermined threshold temperature and either one of the clamping arms comprising a rod selectively extendible towards the operating position, and an actuator assembly including a frame, a handle, a drive mechanism and a locking mechanism, the frame being coupled to the remaining one of the clamping arms;

the drive mechanism comprising a camming tab having a first cavity for slidably receiving the rod and which is sized to selectively engage the rod to effect its axial extension towards the operating position under bias of the handle; and the locking mechanism operable to selectively lock the clamping arms in the operating position, wherein melting of the fusible link in the operating position releases the clamping arms to effect their disengagement from the opening.

14. The shut-off tool of claim 13, wherein each of the clamping arms comprise a resiliently deformable tip.

15. The shut-off tool of claim 13, wherein the locking mechanism comprises a manual release portion operable to selectively unlock the clamping arms.

16. The shut-off tool of claim 13, wherein the fusible link comprises a low melting solder having a melting point between 125° F. and 500° F.

17. The shut-off tool of claim 13, wherein the actuator assembly comprises a spring assembly for resiliently biasing the clamping arms towards the non-engaged position, and the locking mechanism comprises at least one further fusible link for selectively locking the clamping arms in the operating position against the bias of the spring assembly, wherein the further fusible link is selected to melt at said or another predetermined threshold temperature, and wherein melting of the further fusible link effects unlocking of the clamping arms to permit their movement towards the non-engaged position under the bias of the spring assembly.

18. The shut-off tool of claim 17, wherein the further fusible link comprises first and second link plates each comprising a notch, wherein the notches combine to form a second cavity for slidably receiving the rod and which is sized to selectively engage the rod to prevent its axial retraction against the bias of the spring assembly.

19. The shut-off tool of claim 17, wherein the further fusible link comprises a plurality of link plates, at least one of the plurality of link plates having a second cavity for slidably receiving the rod and which is sized to selectively engage the rod to prevent its axial retraction against the bias of the spring assembly.

* * * * *